US006379547B1

(12) United States Patent
Larsson

(10) Patent No.: US 6,379,547 B1
(45) Date of Patent: Apr. 30, 2002

(54) MOBILE UNIT AND METHOD FOR PURIFYING SLUDGE AND WASTE WATER

(75) Inventor: Bo Larsson, Kalmar (SE)

(73) Assignee: AB Aqua Equipment Co., Kalmar (SE)

( * ) Notice: Subject to any disclaimer, the term of this patent is extended or adjusted under 35 U.S.C. 154(b) by 0 days.

(21) Appl. No.: 09/554,336

(22) PCT Filed: Nov. 12, 1998

(86) PCT No.: PCT/SE98/02046

§ 371 Date: Aug. 7, 2000

§ 102(e) Date: Aug. 7, 2000

(87) PCT Pub. No.: WO99/27205

PCT Pub. Date: Jun. 3, 1999

(30) Foreign Application Priority Data

Nov. 12, 1997 (SE) ..... 9704146

(51) Int. Cl.[7] ..... E03F 7/10

(52) U.S. Cl. ..... 210/609; 210/622; 210/747; 210/784; 210/170; 210/196; 210/241

(58) Field of Search ..... 210/609, 620, 210/622, 631, 170, 195.1, 196, 241, 257.1, 258, 259, 770, 784, 804, 299, 572.2, 202, 747

(56) References Cited

U.S. PATENT DOCUMENTS 1,437,007 A * 11/1922 Otterson ..... 210/241
3,262,571 A * 7/1966 Petretti ..... 210/241
3,525,685 A * 8/1970 Edwards ..... 210/620
3,920,552 A * 11/1975 Elkern ..... 210/241
4,525,277 A * 6/1985 Poulin ..... 210/747
4,578,198 A * 3/1986 Schmidt et al. ..... 210/241
5,312,551 A 5/1994 Perron et al.
5,536,418 A * 7/1996 Foss ..... 210/241
5,630,936 A * 5/1997 Oyzboyd ..... 210/195.3
5,643,443 A 7/1997 Ishikura
5,720,885 A * 2/1998 Moos ..... 210/747
5,833,857 A * 11/1998 Roth ..... 210/747

FOREIGN PATENT DOCUMENTS

DE 2413243 * 9/1975
WO WO 9003474 4/1990

* cited by examiner

*Primary Examiner*—Christopher Upton
(74) *Attorney, Agent, or Firm*—Young & Thompson

(57) ABSTRACT

Method for dewatering of water-containing sludge in a sewage well or the like, wherein the water-containing sludge is collected in a tank, the sludge is separated in a downstream filter and the purified water is returned to the well, wherein at least one adjustable and inflow controlling valve is coupled between a suction tank and a downstream filter, a feeding device is arranged for continuous or intermittent discharge of the sludge separated in the filter to one or more compressing units, intended for compressing of the fed sludge, further comprising a container for storing the compressed sludge and tanks units and pumps for receiving and transporting the squeezed out and purified, respectively, and in the process oxygenated water.

6 Claims, 2 Drawing Sheets

MOBILE UNIT AND METHOD FOR PURIFYING SLUDGE AND WASTE WATER

CROSS REFERENCE TO RELATED APPLICATION

This is the 35 USC 371 national stage of International application PCT/SE98/02046 filed on Nov. 12, 1998, which designated the United States of America.

FIELD OF THE INVENTION

The present invention relates to a mobile unit for dewatering water-containing sludge from a separate sewage system or the like. More specifically, the invention relates to a mobile unit comprising devices for sucking sludge and water from the well, filtering and separating sludge and water and returning purified water, which has been oxygenated in the process, to the well after completion of the process, wherein the separated sludge is compressed and stored in the mobile unit from subsequent emptying. Thus, the invention also relates to a method for dewatering water-containing sludge in a way that helps to return the bacterial or micro flora of the well to an environment that supports an aerobic purification process, made possible with the design of the mobile dewatering unit.

BACKGROUND OF THE INVENTION

Devices of similar kind are known in the prior art, see e.g. European Patent No. 437,465.

In purification of sludge from septic tanks of the so-called three-compartment type, the entire content of the well is normally transported to a local sewage treatment works or sludge dump. Apart from the disadvantage of disturbing the biological decomposition in the well, the procedure also brings the external sewage sludge to cause a disadvantageous and varying load in the receiving purification plant. This works best where there is an even and regulated supply, while the intermittent load from external sludge runs the risk of clogging strainers and filters and involves high stresses on the biological decomposition in the purification plant, the so called bio-step. Attempts to level out the load on the purification plant comprise deposition in a pool with controlled supply to the biological treatment through pumps. However, this would induce high initial costs, space requirements and problems with smell.

SUMMARY OF THE INVENTION

It is an object of the invention to offer a solution to this problem by treating and dewatering the sludge on site, i.e. by the three-compartment well, the septic tank or the like. Apart from the considerably lower load in the purification plant, the advantages of heavily reduced transportation are achieved, at the same time as the biological decomposition in the well is promoted by the addition of oxygenated and purified water.

With the solution according to the invention the well, after purification and separation of sludge, is refilled with its own water containing remaining particles of a certain size for supporting the restored bacterial flora, which is also an objective of the present invention.

The environmental profits directly demonstrable by the device and method according to the invention are the following:

- The purification takes place directly by the source and only sucked sludge water in the range of 3–7% has to be dealt with in a subsequent process in a purification plant;

- No discharge travels to purification plant or other location has to be made in the meanwhile, but the operator may continuously during the entire work shift dewater wells in the local area and at the end of the work shift empty, or in other suitable way, remove the compressed sludge;
- Fewer operational disturbances due to intermittent loads in the purification plant;
- Reduced sludge amounts from the purification plant;
- The micro-flora in the well is maintained and gets better conditions for its work;
- Studies have shown that discharging of suspending substances to infiltration plant or other receiver may be heavily reduced in the order of up to about 75%;
- Lower discharge of nitrogen and phosphorus into ground and receivers;
- No foreign chemical additives such as polymers are necessary;
- The device comprises a possibility to add, during the dewatering process, deposit chemicals for reduction of e.g. phosphorus;
- The dewatered sludge with a dry substance of about 25–35% is suitable for energy production in biogas plants;
- The sludge can be spread on arable land, as it is free from environmentally interfering chemical additives;
- By using a mobile dewatering unit according to the invention there is obtained an improved control of the sludge and a smaller risk of polluting during transport distances;
- In addition, the need for transportation and the petrol consumption are reduced since the dewatering unit only has to be emptied at the end of the work shift, i.e. after the working day;
- The device lacks pressure vessel, which reduces the overall weight of the unit;
- The transported volume can, with the device according to the invention, be reduced to in the order of 5% of the volume transported in conventional sludge emptying.

BRIEF DESCRIPTION OF THE DRAWINGS

Below, the invention will be described in more detail, with reference to the attached, schematic drawings, in which.

DETAILED DESCRIPTION OF THE INVENTION

Figure 1:
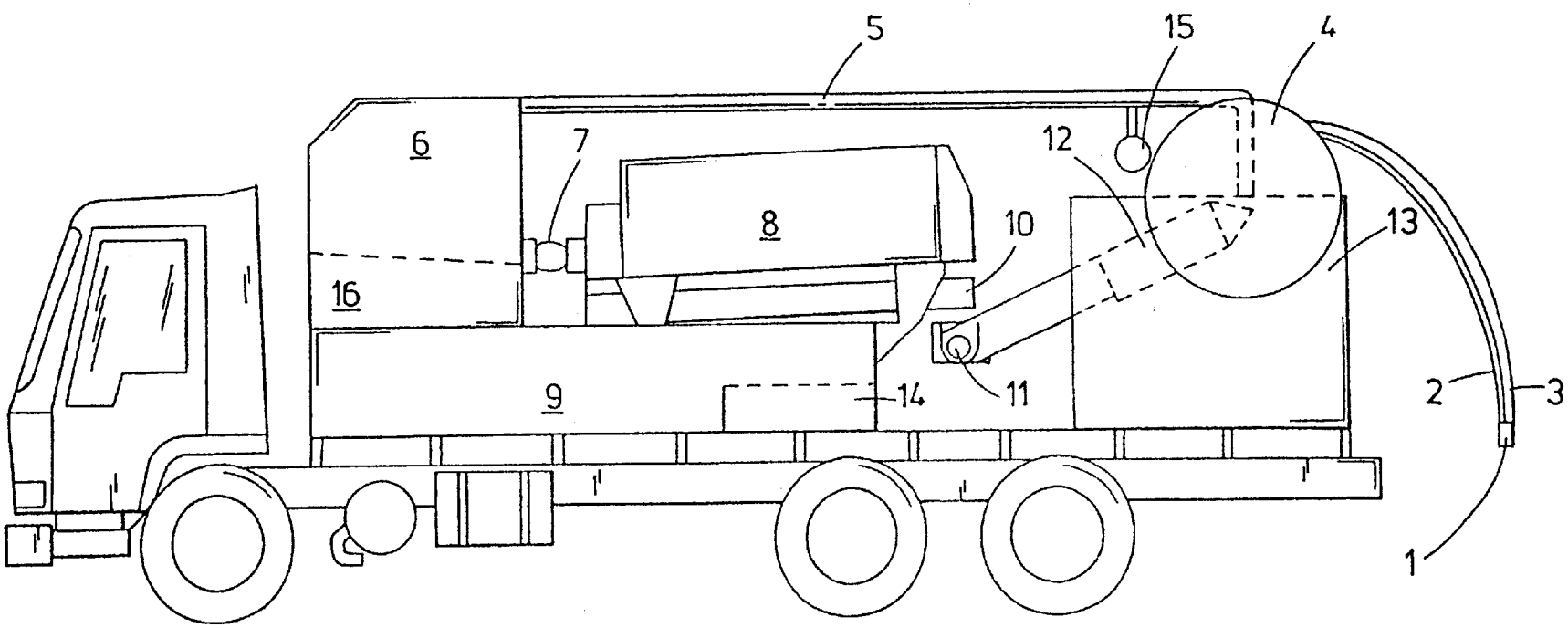
FIG. 1 is an explanatory view of a mobile dewatering unit according to the invention.

The mobile dewatering unit according to the invention, see FIG. 1, is mounted on a car framing and comprises a nozzle 1, a two part hose 2, 3, a hose drum 4, suction pipe 5, suction tank 6, one ore more valves 7, one or more mechanical filters 8, feeding device 10, 11, compressing means 12, sludge container 13, tanks 9 and 14 for receiving purified and squeezed water, respectively, and pipes, pumps and drive means not shown in detail, for receiving and transporting squeezed out and purified water, respectively.

The nozzle 1 is preferably an ejector type nozzle, with which water-containing sludge is sucked by the action of a water jet which is ejected under pressure through the hose 2 into the opening of the suction hose 3 and thereby, through the generated negative pressure, carries sludge and water out of the well. The ejector nozzle is supplied through a pump (not shown) with water from the tank 9, which is refilled with water, which has been purified in the mechanical filter 8, through an inlet (not shown). Said pump is preferably a centrifugal pump, the rotary speed of which is adjustable for controlling the water pressure in the nozzle 1. In addition, the ejector nozzle 1 can be controlled by switches provided in the suction tank 6 and regulating the capacity of the ejector nozzle in relation to the capacity of subsequent processing units, whereby a continuous dewatering process can be performed without interruptions but with the process speed adapted to the nature and consistence of the sludge, the capacity of the processing means, etc.

By the addition of water in the suction phase already there is obtained an oxygenated, diluted and intermixed sludge that facilitates separation in subsequent dewatering steps.

The hose 2, 3 can be a flatly rolled, twin passage hose, in which a narrower passage is arranged to feed water from the tank 9 to the ejector nozzle 1, and a wider passage is arranged to suck water-containing sludge to the suction tank 6 through the suction pipe 5.

The suction tank 6 alternatively comprises a separation wall against which the water-containing sludge surging in is divided and directed to one or more adjustable valves 7 to control the inflow to the downstream mechanical filter 8. The valves 7 are preferably pneumatically controlled and constituted of feed valves with a flow area adjusted in adaptation to the consistence of the sludge and the process speed.

Figure 2:
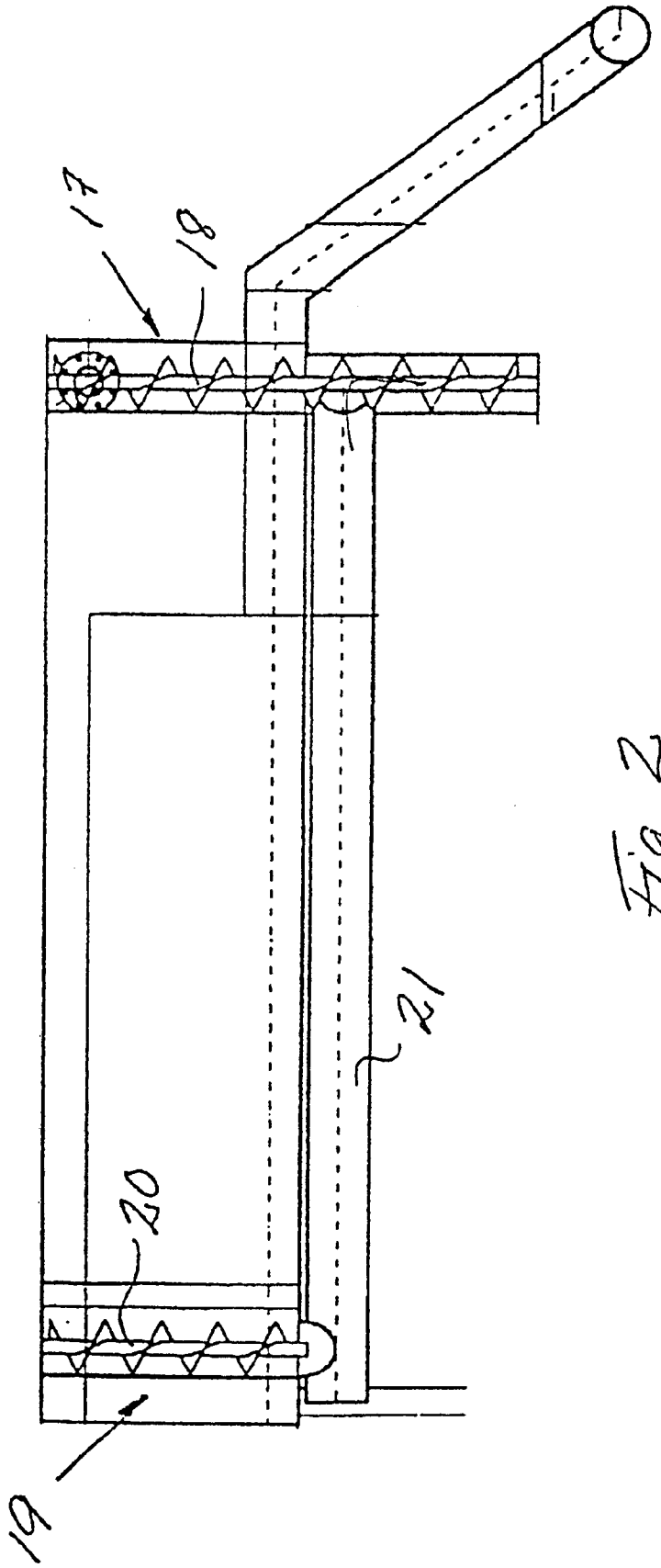
FIG. 2 shows a sedimentation and particle separation device that alternatively may form part of the dewatering unit.

In operational situations where well water contains sand or earth particles there may be required a separation of larger particles and settling of heavier particles before the water is advanced to the downstream mechanical filter. As an alternative, the suction tank may, for this purpose, be provided with strainers and feed screws to separate, in one or more steps, solid particles to a minimum size of 2.0 millimetres. At the inlet of the tank there is in one embodiment, see FIG. 2, arranged a strainer 17, which separates particles larger than e.g. 5 mm, which, with the aid of a feed screw 18, are fed to compression in a subsequent step. The water thus strained in a first step is allowed a rest time in the tank, which permits heavier particles to settle against the bottom of the tank, from where the sediment is fed out for compression or emptying. At the outlet of the tank there is arranged another strainer 19, which separates particles larger than e.g. about 2,0 millimetres and with the aid of one or more feed screws 20, 21 advances these for compression. Suspended particles of smaller size pass the outlet strainer and are fed to the downstream mechanical filter 8.

The mechanical filter or screening cylinder 8 comprises one or more rotationally driven cylindrical drums with perforated shell surfaces, arranged with weak inclination to the horizontal plane, which are supplied with water and sludge through a centrally located hollow axis defining a rotational axis for the drums. Inside, the drums are provided with a helical cam, which during the rotation of the drums feeds the sludge to the rear, elevated end of the drum. Water flowing through the perforation of the drums are led via passages not shown to the tank 9 to be used for the driving of the ejector nozzle 1, and after completed dewatering process to refill the well with its own, now purified and oxygenated water containing an active amount of micro-organisms and particles to supply the organisms with nutrition.

In that respect, it has proven an advantage in maintaining an active bacterial flora after the dewatering method, not to have the perforation of the drums with too fine a mesh but allow suspended particles of a certain, smaller size to remain in the water which from the tank 9 is returned to the well through the nozzle 1. As an example of suitable size for the perforation, the diameter of the holes may preferably be within the range of approx. 0.8 to 20 mm, most preferred is a diameter within the range of 1.2 to 1.8 mm. To achieve the intended effect of an active micro flora in the purified and subsequently refilled water it is also of advantage to have the separation occur not too quickly, but assure a certain rest time in the drum. For this reason the drum can be provided with an inclination towards the horizontal plane and the process flow regulated with the aid of i.e. the controlled valves 7.

From the elevated outlet end of the mechanical filter 8 the sludge separated by the drums is fed to a downstream compression means 12. The feeding can take place e.g. continuously or intermittently with the aid of a feed screw 10, or in any other suitable way, such as with the aid of a linearly moveable feeding plate which is driven intermittently to advance the separated sludge.

The compression means 12 comprises a feed screw and a pressing means, e.g. a slotted press 12. This is mounted to open into a container 3, in which compressed sludge with a dry substance content of about 25–35% is stored for subsequent emptying e.g. with the aid of a feed screw, not shown in detail. Water squeezed out by the compression means is collected into a tank 14 and from there returned, through pipes and pumps, not shown in detail, to the suction tank 6 for repeated purification in the filter 8.

A dosing pump 15 can be provided for adding deposit chemicals in the suction pipe 5 e.g. for reduction of phosphorus.

Further, a water tank 16 is arranged as water reserve, as well as level detector in the tanks for suction water 6, purified water 9 and squeezed out water 14

The ejector nozzle 1 has a valve, not shown in detail, to refill the well after completed dewatering, purified water from the tank 9 being pumped through the nozzle. In this, the original water separated from sludge is returned to the well, and at the same time there is obtained an oxygenation which is beneficent for the bacterial flora, whereby the recovery time for the well is brought down and the biological decomposition is allowed to proceed without the disturbance implied by conventional sludge emptying.

The method for dewatering water-containing sludge using the above-described mobile dewatering unit primarily comprises the following steps:

1. Sucking water and sludge from the well under the addition of air/oxygen,
2. Mechanical separation of water and sludge, alternatively in combination with settling of heavier, solid particles,
3. Compressing and accumulating of separated sludge, and
4. Refilling the well with its own purified and oxygenated water.

The method comprises returning water, squeezed out of the sludge in the compressing means 12, to the dewatering process for repeated passage through the filter 8. The original and sucked water volume thereby undergoes a gradual purification and is, finally, returned to the well as purified, oxygenated water, but containing enough bacterial matter for the maintenance of the returned micro organisms so that the function of the well is guaranteed even after the emptying process.

Studies have shown, that refilling the well with its own, but purified and oxygenated water initiates an aerobic process leading to better values in outgoing water to an infiltration plant or receiver. Thus, an obvious improvement of overall nitrogen and reduction of chemically oxygen consuming compositions has been indicated. The study also indicates heavy reduction of suspending substances by up to 75% in outgoing water, compared to conventional emptying of sludge.

What is claimed is:

1. Method for separating sludge from water in a mobile dewatering unit that is operable for sucking water and sludge from a sewage well, separating sludge from water, and returning the water to the sewage well, the method comprising the following process steps:

providing a water driven ejector for lifting water and sludge from the sewage well to be mechanically separated in the mobile dewatering unit;

providing at least one screening cylinder having a perforated cylinder wall with perforations having a hole diameter of about 0.8 mm to about 2.0 mm;

feeding the water and sludge for mechanical separation in the screening cylinder by forcing the sludge axially through the cylinder with a helical cam;

collecting and recycling separated sewage water under pressure to drive the ejector until substantially the total volume of water and sludge is lifted from the well and contained in the dewatering unit for mechanical separation; and returning the water, containing particles have a maximum particle size of about 0.8 mm to about 2.0 mm to refill the sewage well, through said ejector.

2. The method according to claim 1, wherein mechanical separation is performed by a screening cylinder having perforations with a hole diameter of about 1.2 mm to about 1.8 mm, and returning the water with a maximum particle size of about 1.2 mm to about 1.8 mm.

3. The method according to claim 1, further comprising a settling step preceded by mechanical separation of particles larger than about 5 mm, followed by output of unsettled particles not larger than about 2 mm.

4. The method according to claim 1, further comprising adding to the water in the dewatering unit agents for reducing phosphorus or nitrogen.

5. A mobile dewatering unit for separation of sludge particles from water in a sewage well and for returning the separated water with substantially maintained micro flora to the well after separation, comprising:

a liquid driven ejector for lifting water and sludge from the well into the dewatering unit to be mechanically separated;

at least one screening cylinder for mechanical separation of sludge and water;

feed means for forcing the sludge axially through the screening cylinder;

means for collecting the separated water to be recycled through the ejector; and pumps for recycling the separated water under pressure to drive the ejector until substantially the total volume of water and sludge from the well is contained in the dewatering unit for mechanical separation, wherein the at least one screening cylinder has perforations with a hole diameter of about 0.8 mm to about 2.0 mm.

6. The mobile dewatering unit according to claim 5, wherein the screening cylinder has perforations with a hole diameter of about 1.2 mm to about 1.8 mm.

* * * * *